United States Patent [19]

Radford et al.

[11] 4,095,497

[45] Jun. 20, 1978

[54] ARTICLE HANDLING APPARATUS

[75] Inventors: Billy R. Radford, Princeton; Thomas Linwood McLamb, Four Oaks, both of N.C.

[73] Assignee: GTE Sylvania Incorporated, Stamford, Conn.

[21] Appl. No.: 785,226

[22] Filed: Apr. 6, 1977

[51] Int. Cl.[2] ..... B65H 29/24

[52] U.S. Cl. ..... 83/157; 83/373; 214/6 DK

[58] Field of Search ..... 83/157, 373, 104; 214/6 DK; 271/192, 189

[56] References Cited

U.S. PATENT DOCUMENTS

| | | | |
|---|---|---|---|
| 722,265 | 3/1903 | Swyers | 83/157 X |
| 2,397,192 | 3/1946 | Meyerbach | 83/157 |
| 3,108,509 | 10/1963 | Felix | 83/157 X |
| 3,304,824 | 2/1967 | Hess, Sr. et al. | 83/157 X |
| 3,631,750 | 1/1972 | Hanni | 83/157 |
| 3,811,353 | 5/1974 | Miles | 83/157 X |

*Primary Examiner*—J. M. Meister
*Attorney, Agent, or Firm*—William H. McNeill

[57] ABSTRACT

An apparatus for handling articles, in particular a tray for supporting long flexible material before, during, and after being automatically machine cut, automatically clearing the cut material from the machine such that the cut material is cleared in a "nontangling" manner, and the tray automatically returning to its starting position to support the next material to be cut.

1 Claim, 7 Drawing Figures

Fig. 5
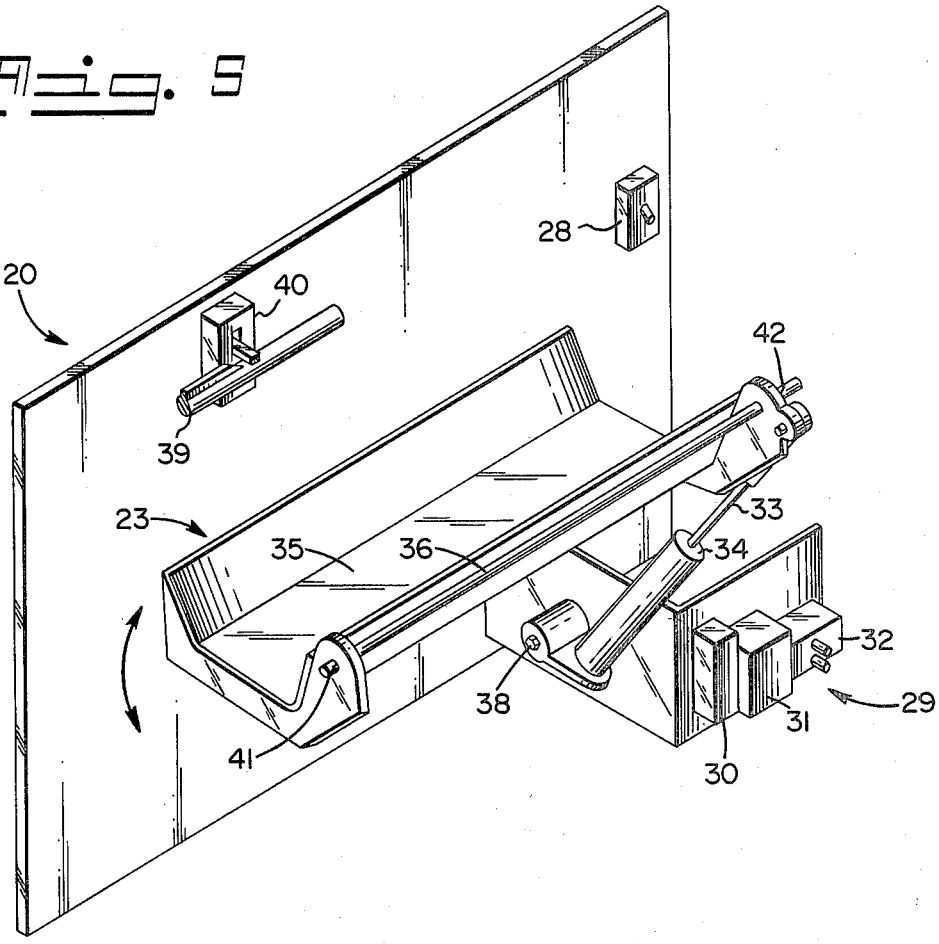
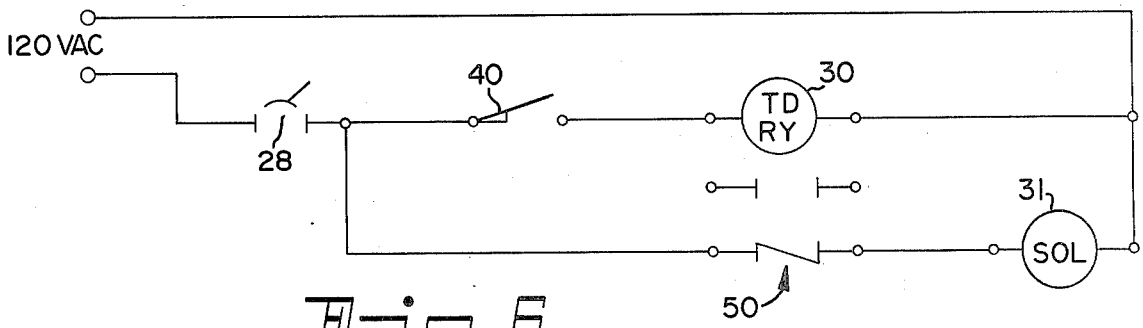
Fig. 6
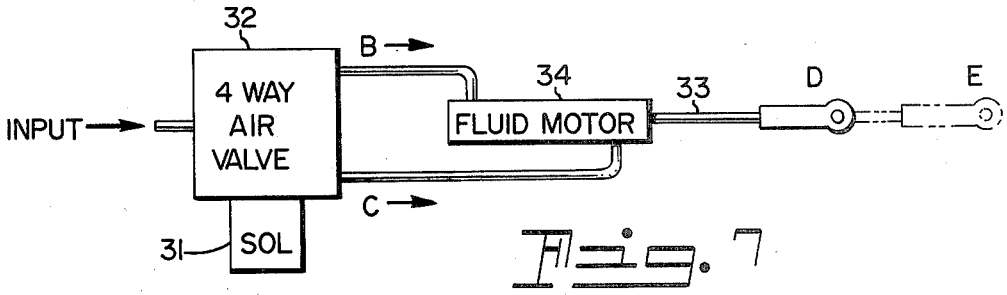
Fig. 7

ARTICLE HANDLING APPARATUS

BACKGROUND OF THE INVENTION

This invention relates to article handling apparatus and more particularly to apparatus for handling long, flexible material such as wire.

When flexible material is automatically cut to a pre-set length on a machine, the material is linearly removed from a spool or supply and automatically fed past the cutter to this pre-set length. All known machines for this purpose either do not support the pre-set length of material beyond the cutter, or they use a two piece (split) tray to support the pre-set length of material before it is cut. Both systems are satisfactory as long as the cut material is relatively short in length. As the length of cut material is increased the tendency for the material to tangle will also increase. Use of a two piece supporting tray does little to alleviate this problem. There are two reasons for this. First, as the length of a two piece tray increases to permit longer cut material, uneven gaps materialize in the supporting tray due to usage, handling and/or warpage. For some materials, this gap does not affect the material from properly sliding onto the tray. For other materials, the material can get caught in an uneven gap causing the material to "tangle" while sliding onto the tray. Secondly, even though a material may slide properly onto the supporting tray, it often becomes tangled while being cleared from from the machine because it (the material) is only supported until the material is cut. At the moment the material is cut, the tray releases the material, only a portion of which was firmly supported by the tray, but the portion going to the cutter was not supported thus the material is being released or cleared from the machine from an unbalanced start. That is, when the material is cut and simulataneously released, the portion that is supported by the tray wants to fall at a uniform rate (gravity), but the unsupported portion going to the cutter causes the material to twist resulting in a non-uniform rate of fall for the entire length of the cut material resulting in "tangling".

In addition, these two piece piece supporting trays require additional floor space and cannot be disengaged when not being used.

OBJECTS OF THE INVENTION

Accordingly, it is the primary object of this invention to obviate the above-noted and other disadvantages of the prior art.

It is a further object of this invention to provide a new and novel flexible article handling apparatus.

It is a further object of this invention to provide a new and novel flexible article handling apparatus that can be disengaged and which will be automatically self-storing.

It is a further object of this invention to provide a new and novel flexible article handling apparatus that will not require additional floor space.

SUMMARY OF THE INVENTION

These objects are accomplished in one aspect of the invention by the provision of an article handling apparatus for use on a machine for cutting long, flexible material to a length. The handling apparatus includes a one piece tray for supporting long lengths of flexible material before, during, and after cutting, means for pivoting the tray to release to cut material, and means for delaying pivoting of the tray until the cut material is totally supported.

BRIEF DESCRIPTION OF THE DRAWINGS

FIG. 5 is a perspective view of a preferred embodiment of this invention as it would be mounted on an automatic cutting machine;

FIG. 6 is a schematic illustration of the preferred circuitry of this invention; and FIG. 7 is a diagrammatic view of flow diagram of this invention.

DETAILED DESCRIPTION OF THE PREFERRED EMBODIMENTS

For a better understanding of the present invention, together with other and further objects, advantages and capabilities thereof, reference is made to the following disclosure in conjunction with the accompanying drawings.

Figure 1:
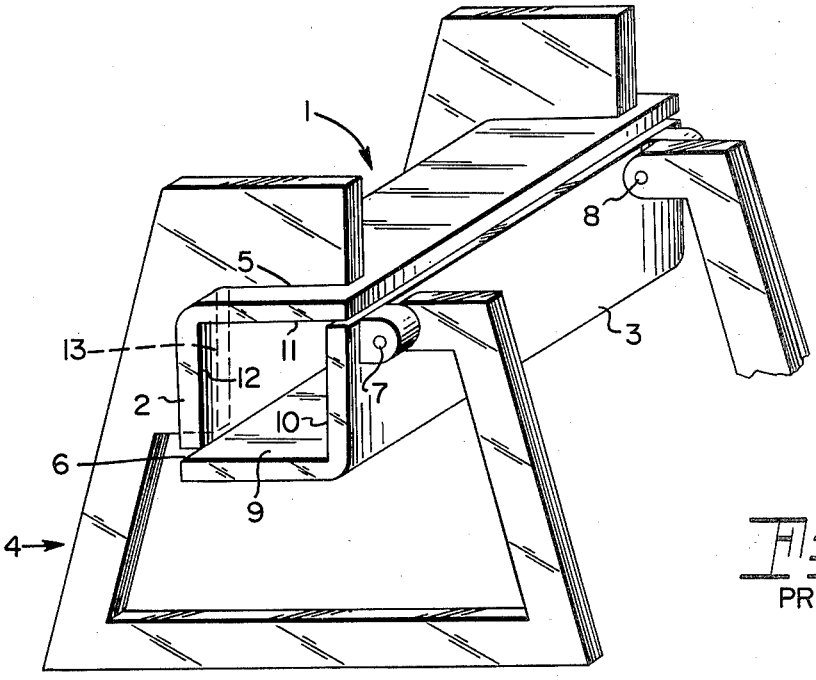
Fig. 1 PRIOR ART
FIG. 1 is a perspective view of a conventional prior art flexible material supporting tray.

Referring first to FIG. 1 there is shown in perspective view a conventional prior art tray 1 composed of wall members 2 and 3 which are mounted to frame 4. Wall member 2 is fixed to frame 4 at surfaces 5 and/or 13 and member 3 has a means for pivoting on frame 4 at points 7 and 8. The tray 1 and frame 4 assembly are placed in line with the material cutter and mechanically, electrically, and pneumatically connected to the machine so it operates with the cutting cycle of the machine. The length of the tray 1 and frame 4 assembly generally extends the length of the machine thus requiring more floor space. Tray 1, formed by surfaces 9, 10 of wall member 3 and surface 11, and 12 of wall member 2 is aligned such that surface 9 supports a portion ofthe pre-set length of flexible material before it is machine cut to length. Gap 6 inherently exists with this type of design and causes some flexible material to "catch" while sliding onto tray 1 resulting in "tangling" of the flexible material. When the material is cut, member 3 pivots, swinging outwardly sufficiently to permit the cut pre-set length of material to slide off surface 9. Member 3 then completes the cycle by swinging inward and returns to its original position. Tray 1 is needed while machine cutting long lengths of flexible material but, it must also be used while cutting short lengths because tray 1 cannot be readily disengaged from the machine or system.

Figure 2:
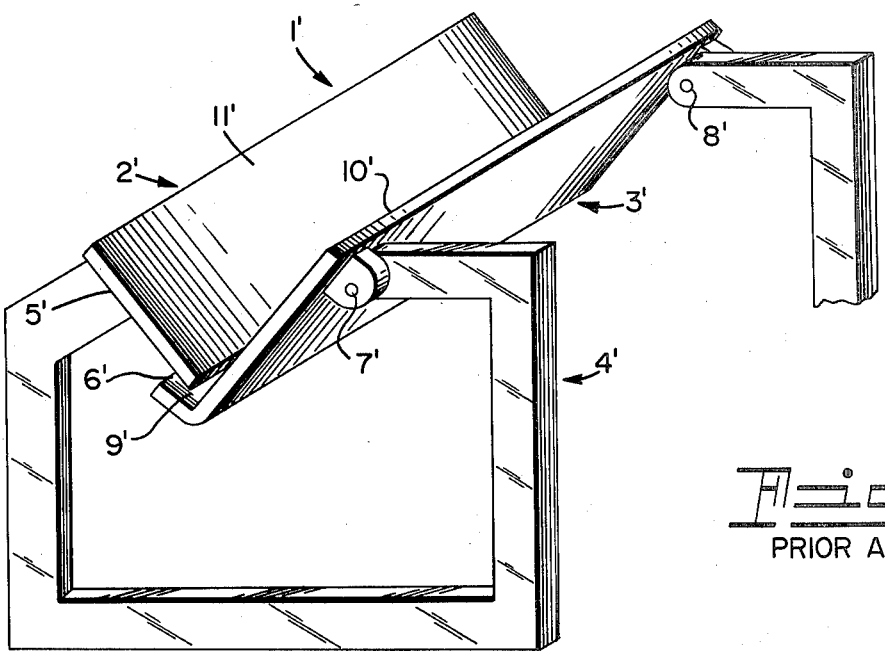
Fig. 2 PRIOR ART
FIG. 2 is a perspective view of another conventional prior art flexible material supporting tray.

Referring next to FIG. 2 there is shown in perspective view another form of a conventional prior art tray 1' composed of members 2' and 3' which are mounted to frame 4'. Member 2' is fixed to frame 4' at surface 5' and member 3' has a means for pivoting on frame 4' at points 7' and 8'. The tray 1' and frame 4' assembly is placed in line with the material cutter and mechanically, electrically, and pneumatically connected to the machine so it operates with the cutting cycle of the machine. The length of the tray 1' and frame 4' assembly generally extends the length of the machine thus requiring more floor space. Tray 1', formed by surfaces 9', 10' of member 3' and surface 11' of member 2' is aligned such that the junction of surfaces 10' and 11' supports portion of the pre-set length of flexible material before it is machine cut to length. Gap 6' inherently exists with this type of design and causes some flexible material to "catch" while sliding onto tray 1 resulting in "tangling" of the flexible material. When the material is cut, member 3' pivots, swinging outwardly sufficiently to permit the cut pre-set length of material to slide off surface 9'. Member 3' then completes the cycle by swinging inward and returns to its original position. Tray 1' is needed while machine cutting long lengths of flexible material but it must also be used while cutting short length because tray 1' cannot be readily disengaged from the machine or system.

Figure 3:
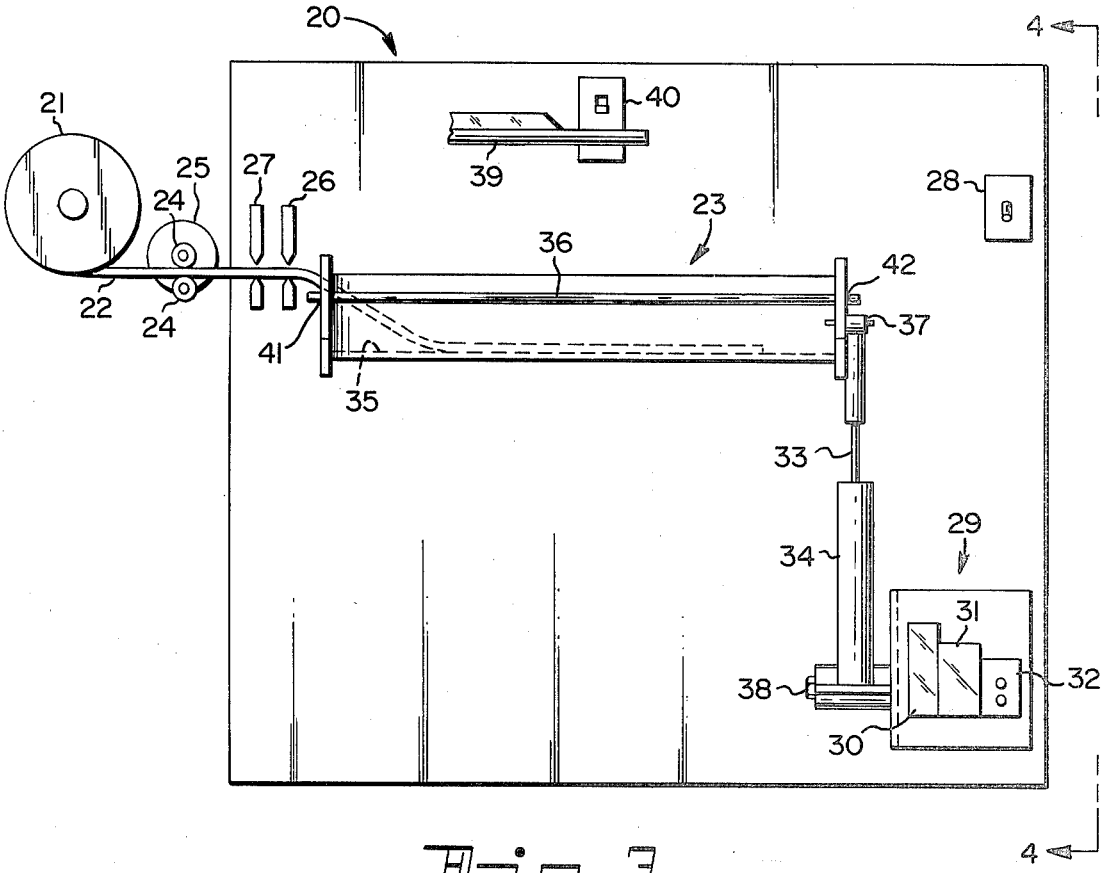
FIG. 3 is an outline drawing of a preferred embodiment of this invention mounted on an automatic wire cutting and stripping machine.
Figure 4:
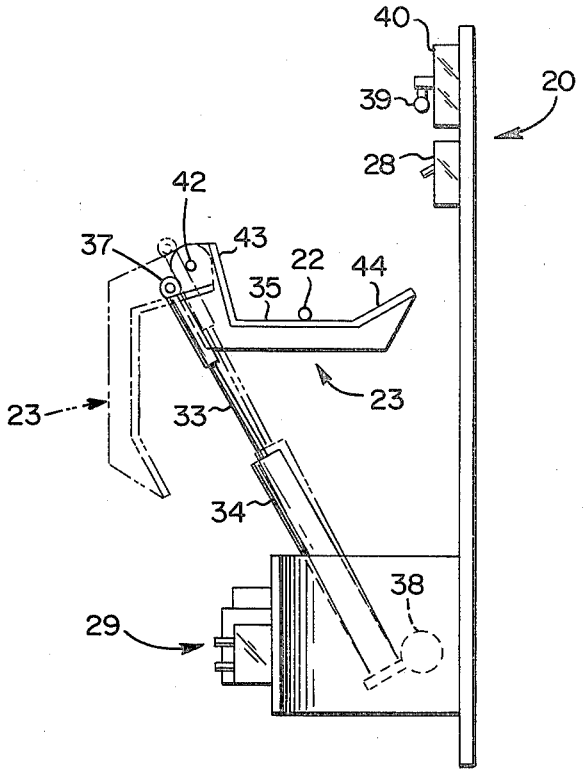
FIG. 4 is an end view taken along the line 4—4 of FIG. 3.

Illustrated diagrammatically in FIG. 3 and FIG. 4 is a more or less typical machine 20, used for automatically cutting and stripping flexible wire. Attached to machine 20 is wire supply 21 containing wire 22. Wire 22, which may range in diameter from no. 16 to no. 24 gauge, is linearly removed from supply 21 and fed onto surface 35 of the one piece closed tray 23 by the rotation of rollers 24. The pre-set electrically controlled rotation of wheel 25 determines the (pre-set) length of wire to be cut and stripped. The cutting and stripping of wire 22 is accomplished by the edges of members 26 and 27 respectively.

Tray 23 pivots on rod 36 at points 41 and 42 and is tilted by means of the linear motion of arm 33 of fluid motor 34. Arm 33 pivots at point 37. Fluid motor 34, pivoting at point 38, is controlled by mechanism 29 comprising time delay relay 30, three-way solenoid valve 31 and four-way air valve 32. Mechanism 29 is energized when switch 28 is switched "ON". In this energized state, mechanism 29 directs arm 33 of fluid motor 34 to retract which places tray 23 in a horizontal position to receive the pre-set length of wire.

At the same time that wire 22 is cut and stripped, member 39 of machine 20 closes switch 40 which is mounted to machine 20. In this energized state, time delay relay 30 of mechanism 29 is energized which sets up a delay to permit the cut and stripped end of wire 22 to lie flat on surface 35 of tray 23 before mechanism 29 proceeds to direct arm 33 of fluid motor 34 to extend which tilts tray 23 downward approximately 90° which permits the flat, straight length of wire 22 to slide off tray 23 as a straight length without tangling. As machine 20 continues to cycle, member 39 disengages switch 40 which opens the switch. In this energized state, which was described earlier, mechanism 29 again directs arm 33 of fluid motor 34 to retract which places tray 23 in a horizontal position to receive the next pre-set length of wire.

Mechanism 29 is de-energized when switch 28 is switched "OFF". In this de-energized state, the air flow to fluid motor 34 is reversed which directs arm 33 of fluid motor 34 to extend thus tilting tray 23 downward approximately 90°. In this position, tray 23 is in a stored position, out of the way of the operation of machine 20 if it is used without benefit of the handling apparatus.

Referring to FIG. 4 there is shown an end view of machine 20 showing the one piece closed tray 23, comprising surfaces 35, 43, and 44, in the horizontal position with wire 22 fed onto surface 35. There is also shown the tilted position of tray 23 when arm 33 of fluid motor 34 extends. This is the position of tray 23 when the flat, straight length of flexible wire slides off surfaces 35 and 44 and also the stored position of tray 23.

DESCRIPTION OF ONE SEQUENCE OF OPERATION

Referring to FIG. 5 there is shown in perspective view a representative form of handling device--according to the invention. Switch 28 is manually operated to engage or disengage this handling apparatus. When switch 28 is switched "OFF", voltage to the three-way solenoid valve 31 is interrupted. This de-energizes the three-way solenoid valve 31 thus reversing the air flow from the four-way air valve 32 to fluid motor 34. The reverse flow of air causes the arm 33 of fluid motor 34 to extend thus tilting tray 23 downward approximately 90°. Tray 23 pivots on rod 36 at points 41 and 42. In this position, tray 23 is in a stored position, out of the way of the operation of the machine if it is used without benefit of the handling apparatus. In addition, energy is being conserved, wear is reduced, and no extra floor space is being utilized.

Operation of this handling apparatus requires switch 28 to be "ON". When switch 28 is switched "ON", voltage energizes the three way solenoid valve 31 through the normally closed contacts of the time delay relay 30. When the three-way solenoid valve 31 is in this energized state, it allows air to flow to fluid motor 34 from the four-way air valve 32. The arm 33 of fluid motor 34 retracts thus tilting tray 23 upward to the horizontal position. The flexible material to be cut is fed past the cutter to the pre-set length and slides onto surface 35 of tray 23. As the machine cycles, the material is cut and at the same time another member 39 on the machine closes switch 40 which is mounted to machine 20. If machine 20 is cutting and stripping wire, switch 40 should close with the last operation being done by machine 20. When switch 40 closes, the time delay relay 30 is energized at the coil and timing mechanism to the relay. This delay allows time for the cut flexible material to drop and lay completely flat and straight on tray 23. At the completion of the delay, normally closed contacts are opened de-energizing the three-way solenoid valve 31 which causes the tray 23 to tilt downward as previously explained permitting the flat, straight length of material to slide off surfaces 35 and 44 of tray 23 as a straight length. As the machine continues to cycle, machine member 39 that has been holding switch 40 closed returns, disengaging switch 40 which permits switch 40 to open. When switch 40 opens, voltage again energizes the three-way solenoid valve 31 which causes tray 23 to be tilted upward as previously explained ready to receive a new pre-set length of flexible material.

Referring to FIG. 6 there is shown in schematic diagram form a representative circuit of the invention. When switch 28 is open (OFF), no energy reaches the circuit. Closing switch 28 energizes the three-way solenoid valve 31. When switch 40 is closed the time delay relay 30 is energized at the coil and timing mechanism of the relay. At the completion of the delay, the normally closed contacts 50 are opened de-energizing the three-way solenoid valve 31. The valve will stay de-energized until switch 40 is again opened.

Referring to FIG. 7 there is shown in block diagram form a representative compressed air flow diagram of this invention. Compressed air is constant at the input of the four-way air valve 32. When the three-way solenoid valve 31 is energized, the air flows on path B to fluid motor 34 causing the arm 33 to retract to position D. When the three-way solenoid valve 31 is de-energized, the air flows on path C to fluid motor 34 causing the arm 33 to extend to position E.

It can be understood from the above-description that there is provided a simple and economical traying device which obviates the disadvantages of the prior art. It readily supports long pieces of flexible material before, during, and after cutting. The built-in delay before dumping insures that the entire length of wire is supported; therefore, it falls evenly, without tangling. Further, when not in use, the mechanism is self-storing and does not use valuable floor space.

While there has been shown and described what is at present considered to be the preferred embodiment of the invention, it will be apparent to those skilled in the art that various changes and modifications can be made herein without departing from the scope of the invention as defined by the appended claims.

What is claimed is:

1. In an apparatus for automatically cutting flexible material to a pre-set length, said apparatus comprising: a supply of a said material; means for linearly removing said material from said supply and delivering said material to a work station; means for measuring said material to said pre-set length; and means at said work station including cutting means for cutting material to said pre-set length, the improvement comprising, traying means adjacent said work station for supporting said pre-set length of said material before, during and after cutting and operable to subsequently deliver said material, after cutting, to a remote location, said traying means being attached to said apparatus and comprising a one piece tray for supporting said material; pivoting means connected to said tray for pivoting said tray whereby cut material is delivered from said tray to said remote location, said tray being self-storing in said pivoted position when not in use; and delay means operatively connected to said pivoting means for delaying operation thereof until said material is cut and entirely supported by said tray.

* * * * *